US008986032B2

(12) United States Patent
Liao

(10) Patent No.: US 8,986,032 B2
(45) Date of Patent: Mar. 24, 2015

(54) MODULAR CONNECTING DEVICE HAVING PROTECTIVE CASING

(71) Applicant: Sheng-Hsin Liao, New Taipei (TW)

(72) Inventor: Sheng-Hsin Liao, New Taipei (TW)

( * ) Notice: Subject to any disclaimer, the term of this patent is extended or adjusted under 35 U.S.C. 154(b) by 7 days.

(21) Appl. No.: 14/023,448

(22) Filed: Sep. 10, 2013

(65) Prior Publication Data

US 2015/0031223 A1 Jan. 29, 2015

(30) Foreign Application Priority Data

Jul. 26, 2013 (TW) ..... 102126855 A

(51) Int. Cl.
*H01R 13/62* (2006.01)
*H01R 13/44* (2006.01)

(52) U.S. Cl.
CPC ..... *H01R 13/44* (2013.01)
USPC ..... 439/304

(58) Field of Classification Search
CPC ..... H01R 13/6397; H01R 13/62933
USPC ..... 439/304, 372, 133, 676, 541.5, 352, 439/353, 354
See application file for complete search history.

(56) References Cited

U.S. PATENT DOCUMENTS

| | | | | | |
|---|---|---|---|---|---|
| 4,544,220 | A * | 10/1985 | Aiello et al. | ..... | 439/594 |
| 5,647,772 | A * | 7/1997 | Martucci et al. | ..... | 439/748 |
| 5,716,233 | A * | 2/1998 | Muzslay | ..... | 439/595 |
| 6,730,882 | B2 * | 5/2004 | Atkinson | ..... | 219/413 |
| 7,351,117 | B1 * | 4/2008 | Mostoller et al. | ..... | 439/744 |
| 2008/0096413 | A1 * | 4/2008 | Chen | ..... | 439/345 |
| 2012/0018529 | A1 * | 1/2012 | Gammon et al. | ..... | 239/6 |

* cited by examiner

*Primary Examiner* — Tulsidas C Patel
*Assistant Examiner* — Phuong T Nguyen
(74) *Attorney, Agent, or Firm* — Li & Cai Intellectual Property (USA) Office

(57) ABSTRACT

A modular connecting device having protective casing includes a first connector, a protective casing, an adaptor, and a protective casing. The first connector has an insertion portion. The protective casing having a case body is movably disposed on the first connector, and the case body of the protective casing is selectively sleeved on the first connector. The adaptor includes a second connector and a third connector. The first connector selectively establishes an electrical connection with the second connector. The third connector is exposed from the case body of the protective casing or received in the case body of the protective casing. The protective cover is selectively sleeved on outer portions of the third connector. Thus, the instant disclosure can be used to protect the connectors and to prevent foreign objects or the connectors per se from being damaged.

15 Claims, 10 Drawing Sheets

MODULAR CONNECTING DEVICE HAVING PROTECTIVE CASING

BACKGROUND OF THE INVENTION

1. Field of the Invention

The instant disclosure relates to a modular connecting device having protective casing; in particular, to a connecting device providing preferred protection.

2. Description of Related Art

Conventional connectors are connection components and other accessories used for electronic signaling and power supply, which can mainly provide bridging and ensure accurate message delivery between various electronic products. Conventional connectors have various types and structures which can be compatible with computers, computer peripherals, industrial equipment, as well as telecommunications, communications, automotive, transportation, medical products, and household appliances.

Majority of conventional connectors has an insulating body and a plurality of ends arranged on the insulating body itself. When the connector is not in use, the insulating body and the end are exposed, which is prone to damages from unintentional scratching and latching or hooking onto foreign objects.

To address the above issues, the inventor strives via associated experience and research to present the instant disclosure, which can effectively improve the limitation described above.

SUMMARY OF THE INVENTION

The object of the instant disclosure is to provide a modular connecting device having protective casing for protecting the connector itself from damages or by foreign objects.

In order to achieve the aforementioned objects, according to an embodiment of the instant disclosure, a modular connecting device having protective casing is provided, which includes a first connector having an insertion portion, a protective casing having a case body, an adaptor having a second connector and a third connector, and a protective cover selectively sleeved on outer portions of the third connector. The protective casing is movably disposed on the first connector, and the case body of the protective casing is selectively sleeved on the first connector. The second connector and the third connector are electrically connected, the second connector and the first connector are selectively in electrical connection with each other, and the third connector is selectively exposed from or received in the case body of the protective casing.

The instant disclosure alternatively provides a modular connecting device having protective casing which includes an adaptor having two connectors electrically connected to each other, a protective casing having a case body, and a protective cover selectively sleeved on outer portions of the two connectors. The protective casing is movably disposed on the adaptor, and the case body of the protective casing is selectively sleeved on the adaptor.

The instant disclosure has the following improvements. The protective casing of the instant disclosure can movably disposed on the first connector, the case body of the protective casing is selectively sleeved on the exterior of the first connector to protect the insertion portion of the first connector or the first connector itself from damages caused by foreign objects. The instant disclosure may separately include the protective cover which provides protection for the adaptor from dust and damages due to scratching.

In order to further understand the instant disclosure, the following embodiments and illustrations are provided. However, the detailed description and drawings are merely illustrative of the disclosure, rather than limiting the scope being defined by the appended claims and equivalents thereof.

DETAILED DESCRIPTION OF THE PREFERRED EMBODIMENTS

First Embodiment

Figure 1:
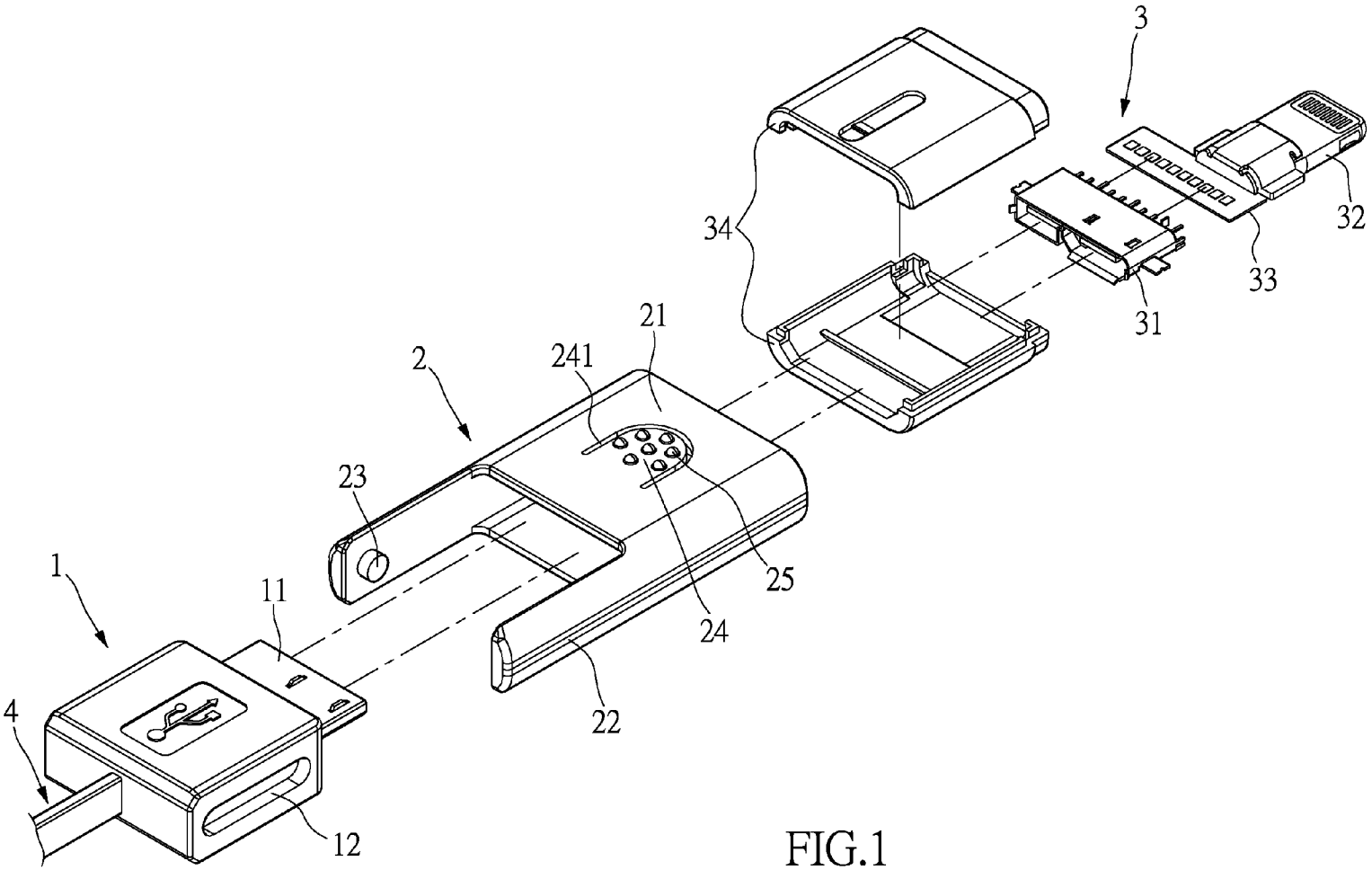
FIG. 1 is an exploded view of a modular connecting device having protective casing in accordance with a first embodiment of the instant disclosure.

Please refer to FIG. 1. The instant disclosure provides a modular connecting device having protective casing which includes a first connector 1, a protective casing 2, and an adaptor 3. The type and structure of the first connector 1 are not limited to USB connectors, IEEE 1394 connectors, HDMI connectors, display port connectors, RJ connectors, AV terminals, DC terminals, connectors which are compatible with mobile phones such as iPhone, or other types of connectors. The first connector 1 includes an insertion portion 11, a track 12, and a pivotable portion 13. In the instant disclosure, the first connector 1 is a Micro-B USB 3.0 connector which can be electrically connected to a cable 4 or other devices. The cable 4 can be flat or round cables but are not limited herein. The structure of the first connector 1 is well known in the art, thus, not further disclosed.

The protective casing 2 is made of plastics or metallic materials but is not limited herein. The protective casing 2 has a hollow case body 21 which is selectively sleeved onto the first connector 1. In other words, the case body 21 of the protective casing 2 can be selectively sleeved onto at least a portion or portions (such as the insertion portion 11) of the first connector 1 or alternatively not sleeved onto the first connector 1.

The shape and structure of the protective casing 2 are not limited herein but can be modified to fit the shape and structure of the first connector 1. In the instant embodiment, the case body 21 is substantially a rectangular shaped hollow body corresponding to the insertion portion 11 of the first connector 1. The size, height, width, and length of the case body 21 is larger than the size of the insertion portion 11 such that the insertion portion 11 can be selectively received in the case body 21 with a preferred and predetermined gap therebetween.

In the instant embodiment, the protective casing 2 further has two coupling arms 22. The two coupling arms 22 can be movably disposed on the first connector 1. The two coupling arms 22 can be extended from two lateral sides of the case body 21. The two coupling arms 22 and the case body 21 can be fixedly connected or pivotally connected therebetween. In the instant embodiment, the two coupling arms 22 and the case body 21 are integrally formed as one body, in other words, fixedly connected. The two coupling arms 22 each has a pivotable portion 23 formed on inner portions of each coupling arms 22. The pivotable portion 23 can be a shaft or an axle type of structure. Moreover, two lateral sides of the first connector 1 have corresponding tracks 12 arranged thereon. The pivotable portions 23 of the protective casing 2 are slidably engaged to the tracks 12 such that the protective casing 2 can slidably disposed on the first connector 1. The first connector 1 can move and rotate in various directions between the two coupling arms 22 via sliding movements between the pivotable portions 23 of the protective casing 2 and the tracks 12 of the first connector 1.

The pivotable portion 23 of the protective casing 2 can slide to near an end portion of the track 12 of the first connector 1 such that the case body 21 of the protective casing 2 is sleeved over the insertion portion 11 of the first connector 1. The two coupling arms 22 of the protective casing 2 can envelop and protect two lateral sides of the first connector 1. The pivotable portions 23 of the protective casing 2 can also slide to a front portion of the track 12 of the first connector 1, and then rotate the protective casing 2 to various directions in order to reveal the insertion portion 11 of the first connector 1 and thus, facilitate establishing a connection with another corresponding connector.

The adaptor 3 has a second connector 31 and a third connector 32 electrically connected to the second connector 31 via a circuit board 33 or other conductive components. The type and structure of the second connector 31 and the third connector 32 can be USB connectors, IEEE 1394 connectors, HDMI connectors, display port connectors, RJ connectors, AV terminals, DC terminals, connectors which are compatible with mobile phones such as iPhone, or other types of connectors, but are not limited herein. The second connector 31 is also a Micro-B USB 3.0 connector corresponding to the first connector 1. The second connector 31 and the third connector 32 can further be encased by an outer shell 34.

The second connector 31 and the first connector 1 are coupled to establish electrical connectivity. When the second connector 31 and the first connector 1 are coupled, the adaptor 3 can immediately establish electrical connectivity with the first connector 1 such that the first connector 1 can be inserted into another corresponding connector via the third connector 32 of the adaptor 3. The pivotable portion 23 of the protective casing 2 can slide to an end portion of the track 12 of the first connector 1 such that the third connector 32 is exposed from the case body 21 of the protective casing 2 to facilitate insertion to another corresponding connector. The pivotable portion 23 of the protective casing 2 can also slide from a front portion of the track 12 of the first connector 1 such that the third connector 32 is received and protected in the case body 21 of the protective casing 2.

The case body 21 of the protective casing 2 may include a pressable portion 24 flexibly move upwards and downwards and arranged on top and bottom portions of the case body 21. In the instant embodiment, the pressable portion 24 has a U-shaped cut slit 241 arranged proximate to the peripheral portion thereof. The slit 241 thus provides the flexible upward and downward movement for the pressable portion 24. Lateral portions of the pressable portion 24 may have small protrusions or bump-like slip-resistant surface 25 arranged thereon. When users prefer to separate the adaptor 3 and the first connector 1, two pressable portions 24 on the case body 21 can be pressed against. Successively, inner portions of the two pressable portions 24 immediately press against top and bottom portions of the adaptor 3 such that the adaptor 3 is clamped between the two pressable portions 24, and the protective casing 2 and the adaptor 3 can be displaced simultaneously. As a result, the protective casing 2 and the adaptor 3 can be displaced away from the first connector 1 such that the second connector 31 of the adaptor 3 and the first connector 1 are separated.

Figure 5:
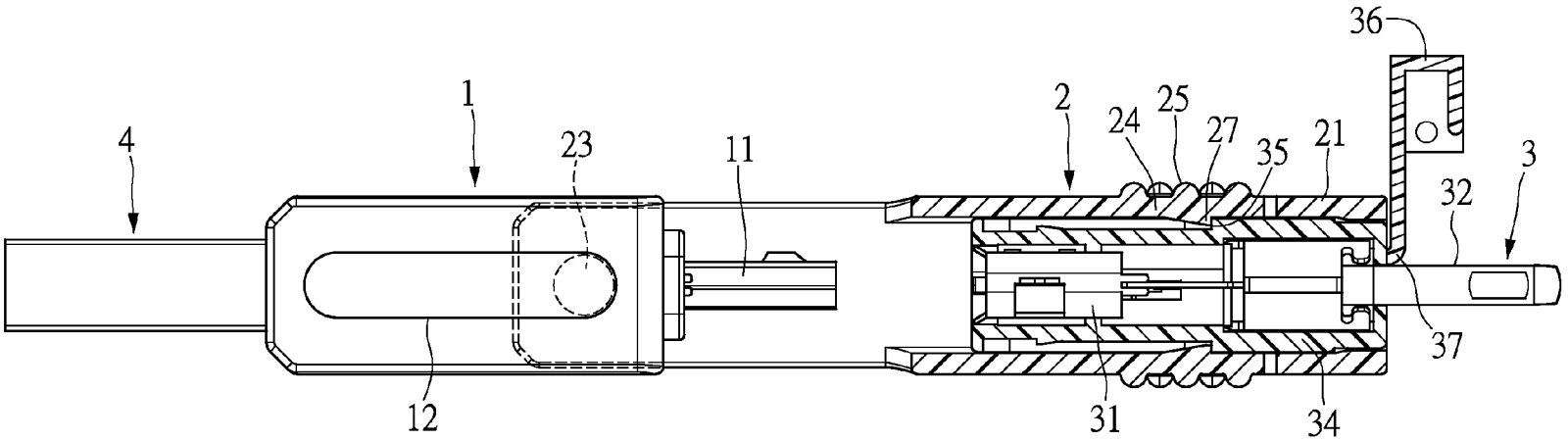
FIG. 5 is a cross-sectional view of the modular connecting device having protective casing in accordance with the fourth embodiment of the instant disclosure.

Inner portions of two pressable portions 24 selectively abut top and bottom portions of the adaptor 3. In addition, inner portions of two pressable portions 24 as well as top portions and bottom portions of the adaptor 3 can further include coupling structures 27, 35 arranged thereon (as shown in FIG. 5). As a result, when the two pressable portions 24 are pressed, the coupling structures 27, mutually coupled to or wedged against each other. Inner portions of the two pressable portions 24 can further securely abut top and bottom portions of the adaptor 3. The coupling structures 27, 35 can be corresponding protrusions or can be a corresponding pair of mortise and tenon structure, in other words, protrusion and groove type of structure.

In another embodiment of the instant disclosure, the two coupling arms 22 of the protective casing 2 respectively have tracks (not shown in figures) arranged on inner portions thereof, whereas two lateral sides of the first connector 1 has corresponding pivotable portions (not shown in figures) formed thereon. The tracks of the protective casing 2 and the pivotable portions of the first connector 1 are slidably engaged to each other such that the first connector 1 can be displaced and rotated in various directions between the two coupling arms 22. Two coupling arms 22 and the case body 21 may form pivotal connections therebetween. In other words, the two coupling arms 22 are pivotally connected to and rotate about the case body 21.

Second Embodiment

Figure 2:
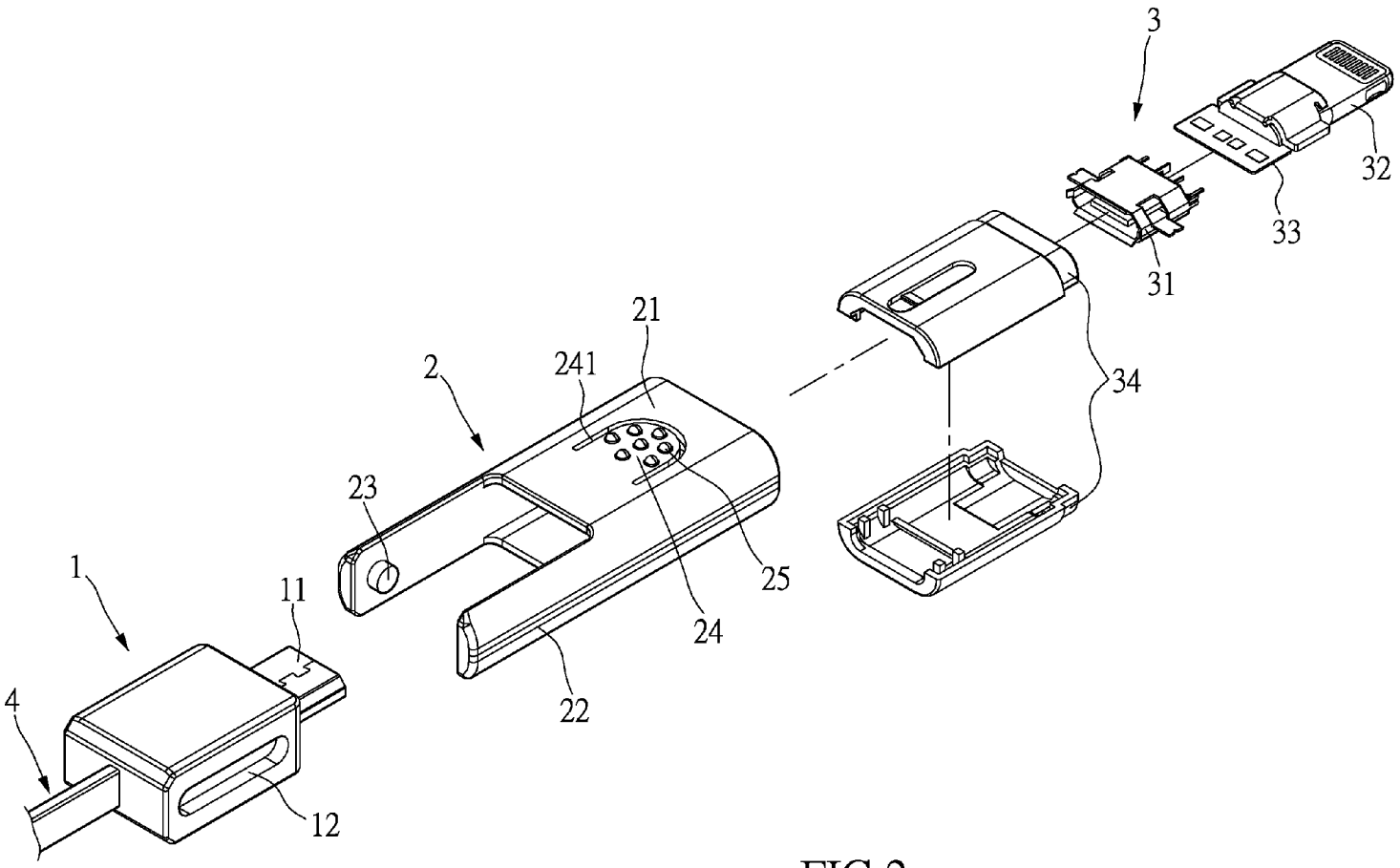
FIG. 2 is an exploded view of the modular connecting device having protective casing in accordance with a second embodiment of the instant disclosure.

Please refer to FIG. 2. In the instant embodiment, the first connector 1 can be a Micro-B USB 2.0 connector. The first connector 1 further connects to two adaptors 5, 6. Adaptors 5, 6 can be a type of connecting device and each adaptor 5, 6 has two electrically connected connectors (not shown in figures). The first connector 1 and the two adaptors 5, 6 are plugged to each other to establish electrical connectivity. The adaptor 5 has two coupling arms 51. Inner portions of the two coupling arms 51 have pivotable portions 52 arranged thereon. The two pivotable portions 52 and the tracks 12 along two lateral sides of the first connector 1 are slidably engaged. The two pivotable portions 23 of the protective casing 2 and the tracks 52 along two lateral sides of the adaptor 5 are slidably engaged such that the protective casing 2 can be movably disposed on the adaptor 5. The case body 21 of the protective casing 2 is selectively sleeved on the adaptors 5, 6.

Third Embodiment

Figure 3:
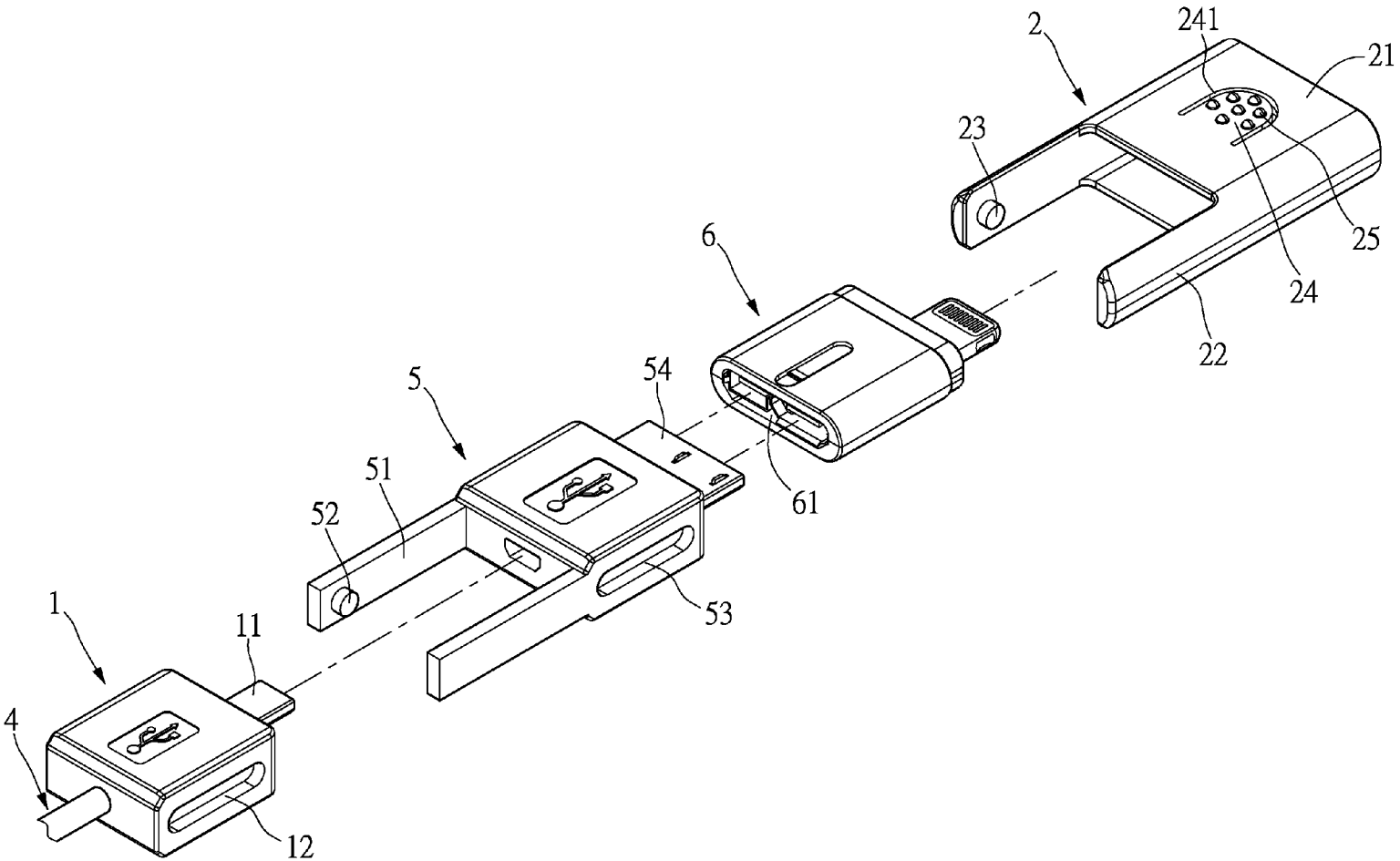
FIG. 3 is an exploded view of the modular connecting device having protective casing in accordance with a third embodiment of the instant disclosure.

Please refer to FIG. 3. In the instant embodiment, the adaptor 5 has a connector 54 at a front end thereof, and the adaptor 6 has a connector 61 at a rear end thereof. The connectors 54, 61 are Micro-B USB 3.0 connectors for establishing a corresponding connection to each other for example. Moreover, the first connector 1 can be an electrical connector having 8 pins or above.

Fourth Embodiment

Figure 4:
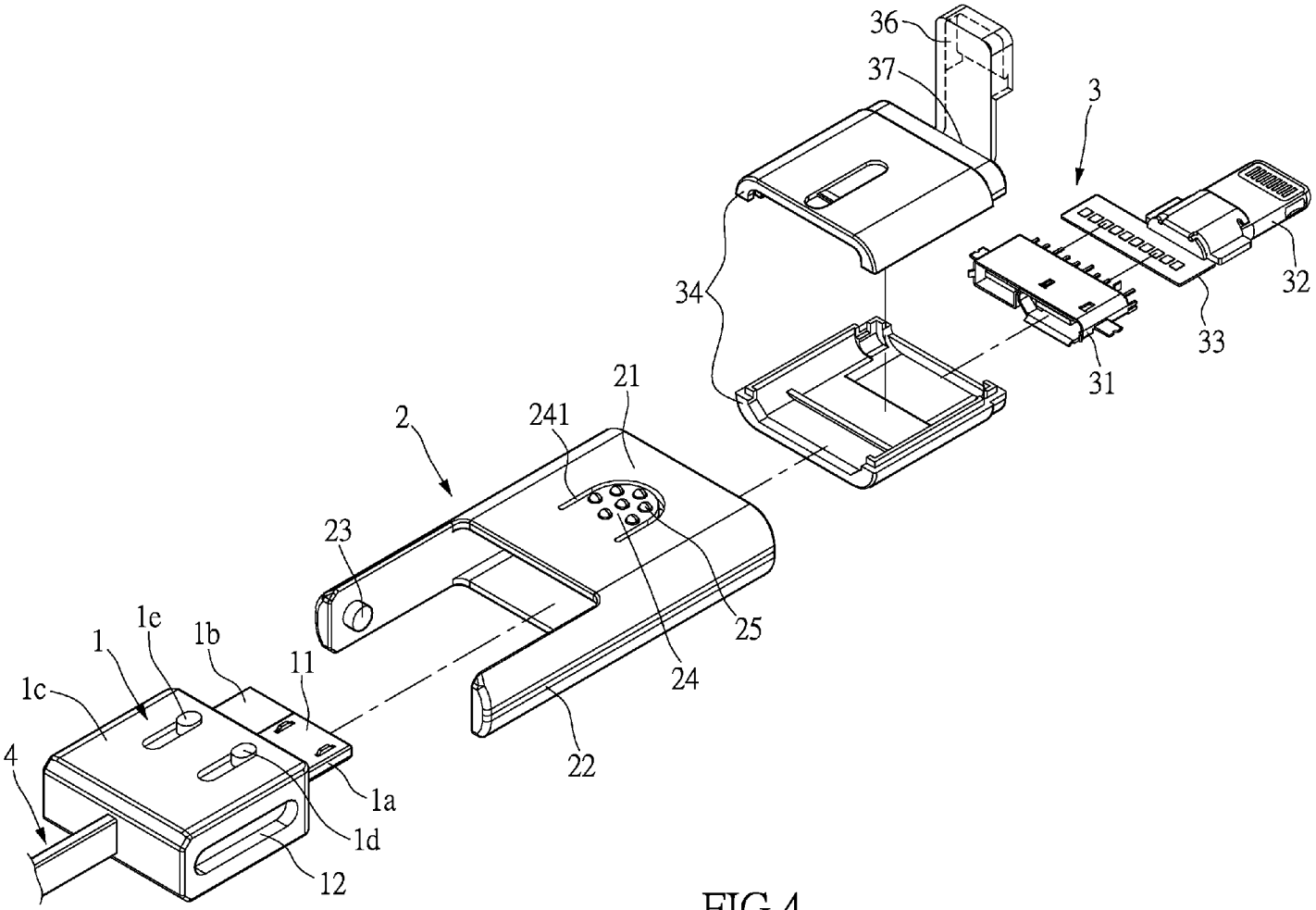
FIG. 4 is an exploded view of the modular connecting device having protective casing in accordance with a fourth embodiment of the instant disclosure.

Please refer to FIGS. 4 and 5. The adaptor 3 in the instant embodiment further has a protective cover 36 disposed thereon. The protective cover 36 may be made of soft or elastic materials. The protective cover 36 can be flipped while connected to the outer shell 34 of the adaptor 3 or other components of the adaptor 3. The protective cover 36 is selectively sleeved on the outer portions of the third connector 32. In order words, the protective cover 36 can be sleeved on or off the third connector 32. The protective cover 36 pivotally connected to the adaptor 3 through a shaft, a hinge, or similar mechanisms capable of providing pivotal connection to the adaptor 3. The protective cover 36 can also be integrally formed with the adaptor 3. In the instant embodiment, the protective cover 36 is integrally connected to the adaptor 3 via a flexible connector 37. To use the third connector 32, the protective cover 36 can be flipped off and away from the third connector 32 such that the third connector 32 is exposed to facilitate insertion into another corresponding connector. When the third connector 32 is not in use, the protective cover 36 can be sleeved onto outer portions of an end of the third connector 32 to protect the third connector 32 (adaptor 3) from dust and scratching, etc.

Please refer to FIG. 4. In the instant embodiment, the first connector 1 complies with Micro-B USB 3.0 standards. The first connector 1 can also be formed with individually movable first module 1*a* and second module 1*b*. The first module 1*a* and the second module 1*b* can slidably extend out of or contract in an outer casing 1*c*. The first module 1*a* and the second module 1*b* can also be connected to a push button 1*d*, 1*e* respectively, such that the first and second modules 1*a*, 1*b* can separately slide in and out of the outer casing 1*c* by pushing the push buttons 1*d*, 1*e* respectively. When the first and second modules 1*a*, 1*b* are both extended, both modules 1*a*, 1*b* is compatible with USB 3.0 connection interfaces. When only the first module 1*a* is extended, the first module 1*a* is compatible with USB 2.0 connection interfaces. Both modules 1*a*, 1*b* can also be contracted into the outer casing 1*c* to hide within the outer casing 1*c* for protection. Moreover, the first and second modules 1*a*, 1*b* can rotatably (flipped and rotate upward or downward) disposed at the outer casing 1*c*, such that both modules 1*a*, 1*b* can simultaneously be used as a USB 3.0 interface connector or only the first module 1*a* is used as a USB 2.0 interface connector.

Fifth Embodiment

Figure 6:
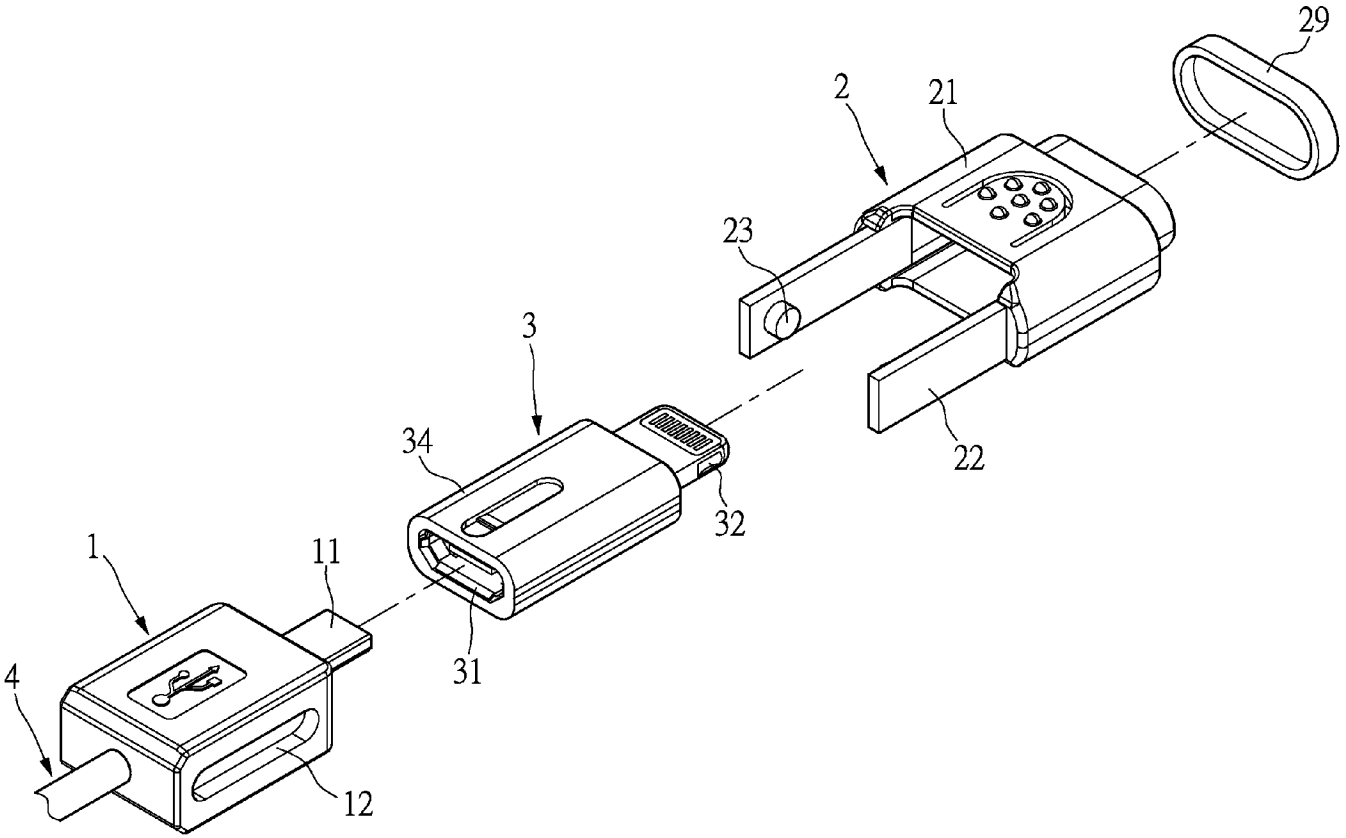
FIG. 6 is an exploded view of the modular connecting device having protective casing in accordance with a fifth embodiment of the instant disclosure.
Figure 7:
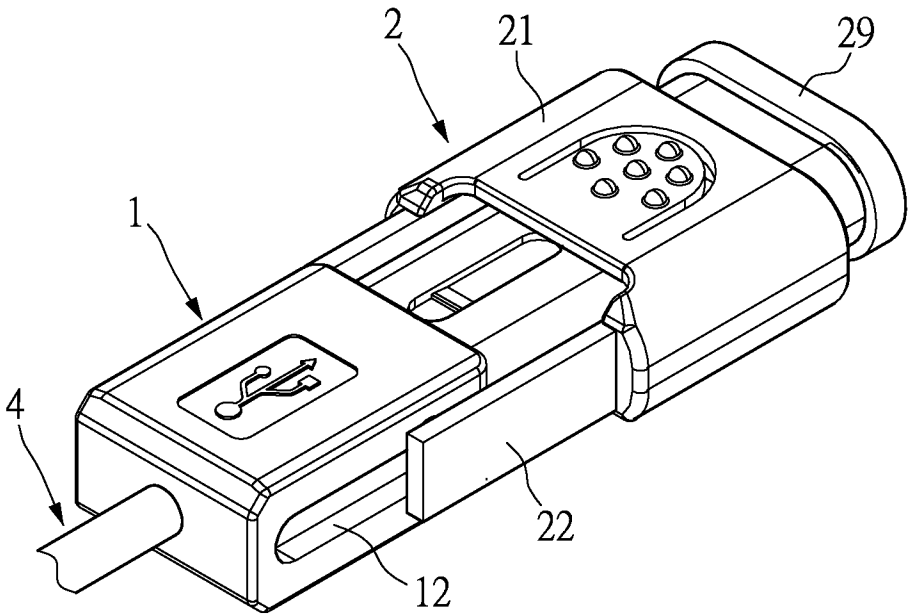
FIG. 7 is a perspective view of the modular connecting device having protective casing in accordance with the fifth embodiment of the instant disclosure.

Please refer to FIGS. 6 and 7. The protective casing 2 of the instant embodiment can be movably disposed on the first connector 1. The case body 21 of the protective casing 2 is selectively sleeved on the adaptor 3. In the instant embodiment, the protective casing 2 further has two coupling arms 22 arranged in the case body 21. The two coupling arms 22 are slidably engaged or slip fitted in the case body 21. Inner portions of each coupling arm 22 have the pivotable portion 23 formed thereon. The pivotable portion 23 of the protective casing 2 and the track 12 of the first connector 1 are mutually slidable with respect to each other, such that the protective casing 2 can be slidably disposed on the first connector 1. Moreover, the case body 21 of the protective casing 21 can also relatively move with respect to the two coupling arms 22. Furthermore, the protective casing 2 of the instant disclosure further has a protective cover 29 disposed thereon. The protective cover 29 is sleeved on a front end of the case body 21, and selectively sleeved on outer portions of the third connector 32 to protect the third connector 32 from dust and scratching, etc.

Sixth Embodiment

Figure 8:
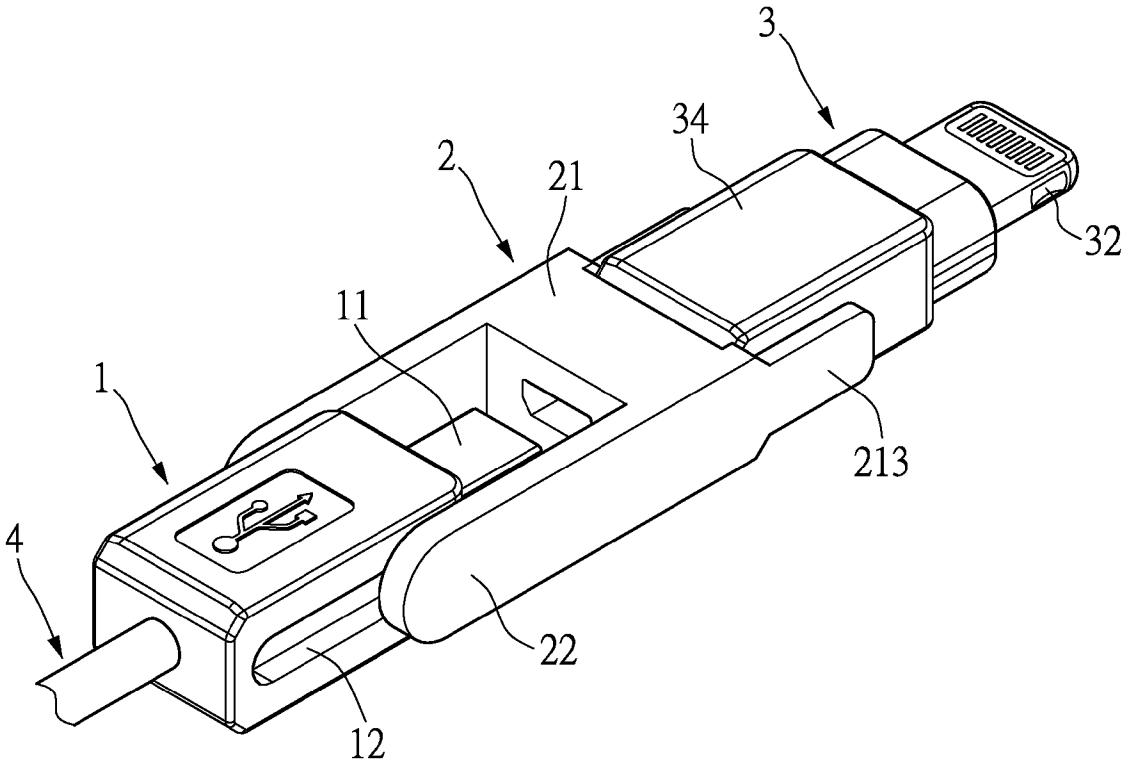
FIG. 8 is a perspective view of the modular connecting device having protective casing in accordance with a sixth embodiment of the instant disclosure.
Figure 9:
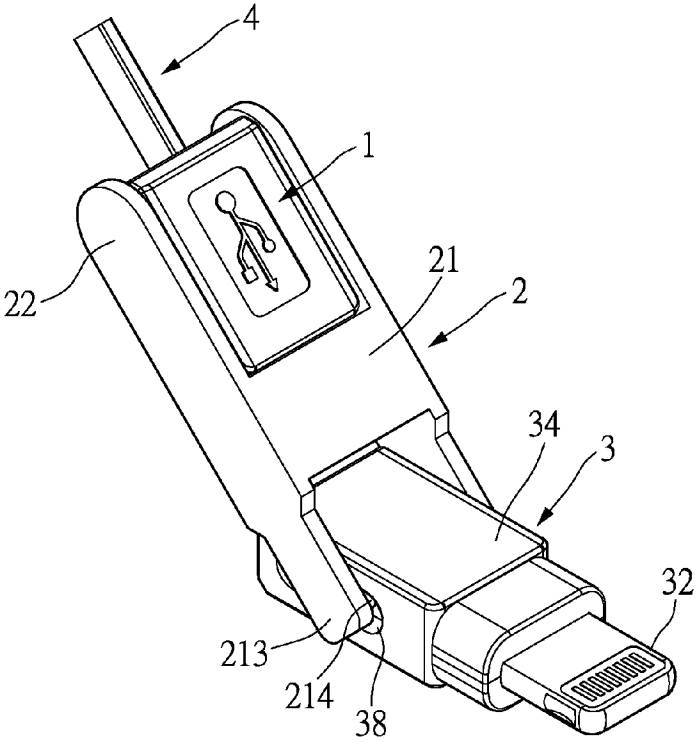
FIG. 9 is another perspective view illustrating another operation mode of the modular connecting device having protective casing in accordance with the sixth embodiment of the instant disclosure.

Please refer to FIGS. 8 and 9. The protective casing 2 of the instant embodiment has a different appearance. The protective casing 2 can be movably disposed on the first connecter 1. The case body 21 of the protective casing 2 is selectively sleeved on the first connector 1. The protective casing 2 further has two extending arms 213 movably disposed on the adaptor 3. Inner portions of each extending arm 213 has a shaft connector 214 formed thereon, whereas two lateral sides of the adaptor 3 respectively has two tracks 38 formed thereon. The two tracks 38 correspond to the two shaft connectors 214. The shaft connectors 214 of the protective casing 2 and the tracks 38 of the adaptor 3 are mutually slidable with respect to each other such that the protective casing 2 can movably disposed on the adaptor 3. The adaptor 3 can move and rotate in different directions between the two extending arms 213 through the mutual sliding between the shaft connectors 214 of the protective casing 2 and the tracks 38 of the adaptor 3.

Seventh Embodiment

Figure 10:
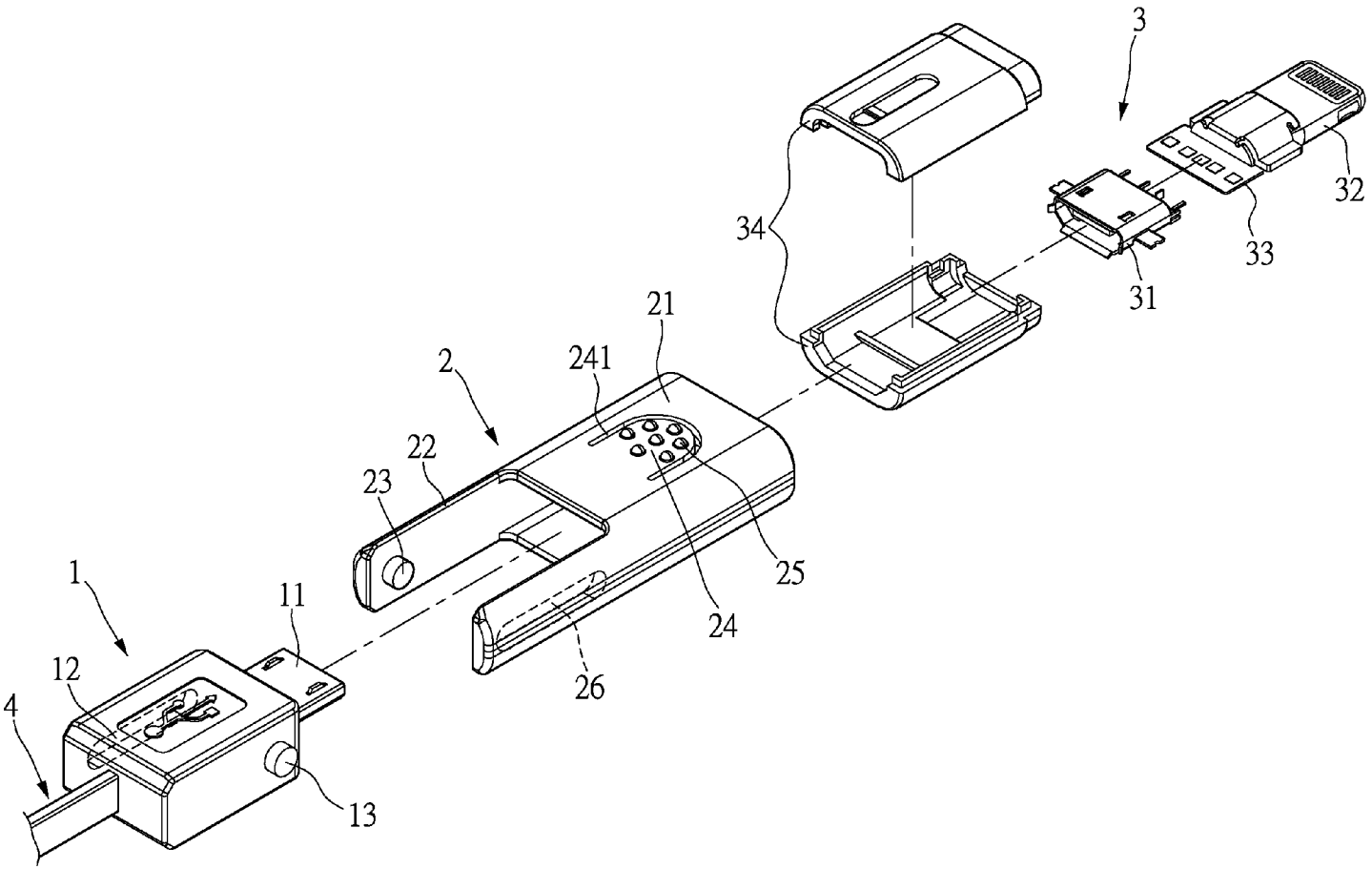
FIG. 10 is an exploded view of the modular connecting device having protective casing in accordance with a seventh embodiment of the instant disclosure.

Please refer to FIG. 10. In the instant embodiment, the protective casing 2 has the two coupling arms 22. Each of the two coupling arms 22 of protective casing 2 has either one pivotable portion 23 or one track 26 formed thereon, whereas each of the two lateral sides of the first connector 1 has either a track 12 or a pivotable portion 13 formed thereon respectively corresponding to the pivotable portion 23 or one track 26. The pivotable portion 23 and the track 26 of the protective casing 2 are respectively and slidably coupled to the track 12 and the pivotable portion 13 of the first connector 1 such that the first connector 1 can move and rotate in various directions between the two coupling arms 22.

In summary, the protective casing of the instant disclosure can be movably disposed on the first connector, and the case body of the protective casing is selectively sleeved on the exterior of the first connector to protect the insertion portion of the first connector or the first connector itself from damages caused by foreign objects. For example, when the first connector is not in use, the protective casing can be sleeved on the exterior of the first connector such that the first connector has preferred protection to prevent scratches or damages from foreign objects. Furthermore, the protective casing can also prevent the first connector from latching or hooking on to foreign objects to prevent damages done to the first connector itself or the foreign objects.

The instant disclosure also includes the protective cover which is selectively sleeved on the exterior of the connector (the third connector) of the adaptor, such that the adaptor is preferably protected from dust and damages due to scratching.

The figures and descriptions supra set forth illustrated the preferred embodiments of the instant disclosure; however, the characteristics of the instant disclosure are by no means restricted thereto. All changes, alternations, combinations or modifications conveniently considered by those skilled in the art are deemed to be encompassed within the scope of the instant disclosure delineated by the following claims.

What is claimed is:

1. A USB modular connecting device having protective casing, comprising:

a first connector having an insertion portion;

a protective casing having a case body, the protective casing movably disposed on the first connector, and the case body of the protective casing selectively sleeved on the first connector;

an adaptor having a second connector and a third connector, the second connector and the third connector electrically connected, the second connector and the first connector selectively in electrical connection with each other, and the third connector selectively exposed from or received in the case body of the protective casing; and a protective cover selectively sleeved on outer portions of the third connector;

wherein the protective casing has two coupling arms movably disposed on the first connector;

wherein inner surfaces of the two coupling arms respectively have two pivotable portions formed thereon, the first connector has at least one track formed on each of two lateral sides of the first connector, and the two pivotable portions of the protective casing are slidably engaged to the two tracks on the two lateral sides of the first connector.

2. The USB modular connecting device having protective casing as recited in claim 1, wherein the case body of the protective casing selectively is sleeved on portions of the first connector.

3. The USB modular connecting device having protective casing as recited in claim 1, wherein the case body of the protective casing selectively is sleeved over the insertion portion of the first connector.

4. The USB modular connecting device having protective casing as recited in claim 1, wherein inner surfaces of the two coupling arms respectively have two tracks formed thereon, the first connector has at least one pivotable portion formed on each of two lateral sides of the first connector, and the two pivotable portions on the two lateral sides of the first connector are slidably engaged to the two tracks of the protective casing.

5. The USB modular connecting device having protective casing as recited in claim 1, wherein the two coupling arms and case body are fixedly connected or pivotally connected.

6. The USB modular connecting device having protective casing as recited in claim 1, wherein the two coupling arms are slidably engaged in the case body.

7. The USB modular connecting device having protective casing as recited in claim 1, wherein the case body of the protective casing has a flexibly upward and downward pressable portion arranged at both top portions and bottom portions of the case body, the two pressable portions have slip-resistant surfaces respectively arranged on outer portions of the two pressable portions, and top portions and bottom portions of the adaptor are engaged to inner portions of the two pressable portions through a coupling structure arranged therebetween.

8. The USB modular connecting device having protective casing as recited in claim 1, wherein the protective cover is sleeved on the adaptor.

9. The USB modular connecting device having protective casing as recited in claim 1, wherein the protective cover is sleeved on the protective casing.

10. The USB modular connecting device having protective casing as recited in claim 1, wherein the first connector has a first module and second module formed thereon, the first module and second module are independently movable with respect to the first connector.

11. The USB modular connecting device having protective casing as recited in claim 1, wherein the protective casing has two extending arms movably disposed on the adaptor.

12. The USB modular connecting device having protective casing as recited in claim 11, wherein each of the two extending arms has a shaft connector formed on inner portions of the extending arm, two lateral sides of the adaptor have tracks formed thereon corresponding to the shaft connectors, and the shaft connectors are slidably engaged to the tracks.

13. A USB modular connecting device having protective casing, comprising:

an adaptor having two connectors electrically connected to each other;

a protective casing having a case body, the protective casing movably disposed on the adaptor, and the case body of the protective casing selectively sleeved on the adaptor; and a protective cover selectively sleeved on outer portions of the two connectors;

wherein the protective casing has two extending arms slidably disposed on the adaptor;

wherein each of the two extending arms has a shaft connector formed on inner portions of the extending arm, two lateral sides of the adaptor have tracks formed thereon corresponding to the shaft connectors, and the shaft connectors are slidably engaged to the tracks.

14. The USB modular connecting device having protective casing as recited in claim 13, wherein the protective cover is sleeved on the adaptor.

15. The USB modular connecting device having protective casing as recited in claim 13, wherein the protective cover is sleeved on the protective casing.

* * * * *